US005409052A

United States Patent [19]

Kaneto et al.

[11] Patent Number: 5,409,052

[45] Date of Patent: Apr. 25, 1995

[54] DEVICE FOR SIMULTANEOUSLY FORMING COPE AND DRAG MOLDS

[75] Inventors: Kimikazu Kaneto, Toyohashi; Minoru Hirata, Toyokawa, both of Japan

[73] Assignee: Sintokogio, Ltd., Aichi, Japan

[21] Appl. No.: 157,909

[22] Filed: Nov. 24, 1993

[30] Foreign Application Priority Data

Nov. 27, 1992 [JP] Japan ..... 4-087761 U

[51] Int. Cl.[6] ..... B22C 11/10; B22C 15/02

[52] U.S. Cl. ..... 164/151.2; 164/150.1; 164/154.2; 164/155.1; 164/172; 164/207; 164/456

[58] Field of Search ..... 164/169, 182, 151.2, 164/150.1, 154.1, 154.2, 155.1, 155.4, 207, 456, 29, 172, 173, 212, 187

[56] References Cited

U.S. PATENT DOCUMENTS 2,848,008 8/1958 Dietert et al. ..... 164/456 X 3,654,986 4/1972 Jansen ..... 164/173

4,345,638 8/1982 Hermes ..... 164/456

FOREIGN PATENT DOCUMENTS 3312539 3/1984 Germany ..... 164/173

60-124441 7/1985 Japan ..... 164/456

*Primary Examiner*—J. Reed Batten, Jr.

*Attorney, Agent, or Firm*—Fish & Neave; Edward Etkin

[57] ABSTRACT

Sand is charged into two spaces defined by a match plate, a pair of flasks, and a pair of squeeze plates, and is then compressed by moving the squeeze plates in the flasks toward the match plate to form the cope and drag molds. The properties of the molding sand are detected during the forming of the molds in order to suitably adjust the sand and the device. The device includes linear encoders connected to the squeeze plates so as to detect the amounts of the movements of the squeeze plates, and an electrode penetrating one squeeze plate so as to detect the electric resistance or the water-content value of the mold in the flask.

1 Claim, 1 Drawing Sheet

DEVICE FOR SIMULTANEOUSLY FORMING COPE AND DRAG MOLDS

BACKGROUND OF THE INVENTION

1. Field of the Invention

The present invention relates to an improved device for simultaneously forming cope and drag molds wherein a match plate is held between a pair of flasks, and wherein at the openings of the flasks, which are positioned at opposite sides of the match plate, a pair of squeeze plates, defining two spaces for receiving molding sand, are each movably mounted so as to compress the molding sand to form the molds.

2. Description of the Prior Art

Conventionally, when molds are formed from molding sand a part of the sand is taken out to examine its water content and to make test pieces to be tested to obtain the strength, degree of air permeability, etc., of the molding sand. After this examination and testing the amount of water to be added to the sand, as well as the squeeze pressure to be applied to the sand, may be adjusted.

However, since such an examination of the properties of the molding sand takes a considerable time before the molds start to be formed, the properties may have changed after such a time-consuming examination. Thus, the examination tends to fail to provide adequate adjustments for the molding sand.

The present invention is made in view of such a drawback. The purpose of the invention is to provide an improved molding device whereby it is possible to directly examine the properties of the molding sand during the cope and drag formation.

SUMMARY OF THE INVENTION

The device of the present invention, for simultaneously forming the cope and the drag molds, comprises a pair of flasks, a match plate held between the flasks, a pair of squeeze plates movably mounted on the flasks at their openings positioned at opposite sides of the match plate so as to define spaces for charging molding sand in them and to compress the sand in order to form the cope and drag molds, a pair of linear encoders connected to the squeeze plates for detecting any linear movement of the flasks, and one electrode mounted on at least one of the squeeze plates. The electrode penetrates the squeeze plate so as to detect the electric resistance to obtain the water-content value of the mold in the flask.

The movements of the flasks from a first position, where the sand is charged in the spaces, to a second position, where the squeezing of the sand is completed, are measured by the linear encoder and then processed by a programmable controller. Also, the electric resistance of the mold is measured by the electrode and then converted into a water-content value. These measurements are used as data for controlling the molding sand and device.

DESCRIPTION OF THE PREFERRED EMBODIMENT

Figure 1:
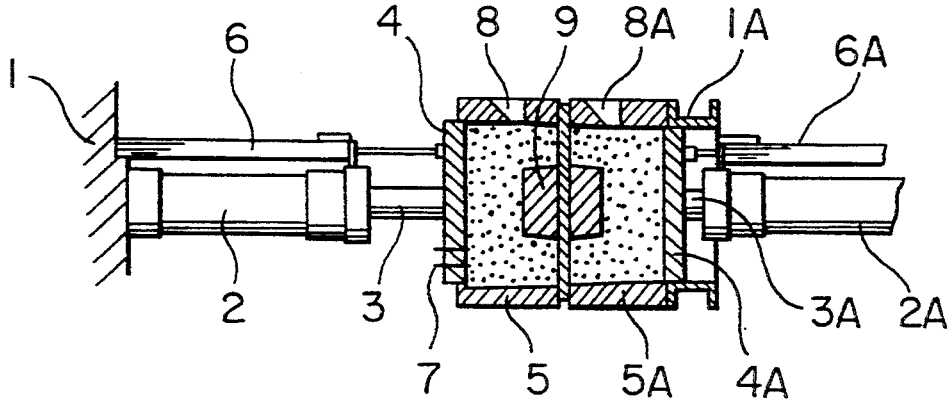
FIG. 1 is a partly diagrammatic sectional view of an embodiment of the device of the present invention, showing a state where molding sand is charged in the device.

The device of the present invention will now be explained through an embodiment, with reference to the accompanying drawings. A pair of cylinders 2 and 2A is laterally mounted on frames 1 and 1A respectively so as to face each other. One of the frames 1 is immovable, while the other frame 1A is movable to the right and left, as in FIGS. 1 and 2, a limited distance by means of a cylinder (not shown). A pair of squeeze plates 4 and 4A is fixed to the distal ends of piston rods 3 and 3A of the cylinders 2 and 2A respectively. The squeeze plates 4 and 4A are mounted on the backs of corresponding flasks 5 and 5A so as to slide in the flasks. One of the flasks, 5A, is secured to the frame 1A, and the frame 1A, the cylinder 2A, and the flask 5, are all integrally movable to the right and left, as in FIGS. 1 and 2.

A pair of linear encoders 6 and 6A is attached to the frames 1 and 1A. The encoders 6 and 6A extend parallel to the cylinders 2 and 2A respectively. The distal ends of the encoders are connected to the backs of the squeeze plates 4 and 4A respectively to detect the amounts of the linear movements of the plates and to produce signals corresponding to the amounts. The signals are sent to a programmable controller (not shown) which processes the signals to obtain the thicknesses of the molds.

An electrode 7 is mounted on at least one squeeze plate 4, as is, for example, shown in FIG. 1. The electrode 7 penetrates the plate 4 and is connected to a programmable controller (not shown) in order to examine the water-content value of the molding sand in the flask 5. The programmable controller uses the data on the thicknesses of the molds and the water-content values to control the molding sand and the device.

Molding sand is charged into the flasks 5 and 5A through ports 8 and 8A formed in the upper walls of the flasks 5 and 5A. A match plate 9 is held between the flasks 5 and 5A and is movable toward and away from the viewer of FIG. 1 by a known transferring means (not shown). The match plate 9, the flasks 5 and 5A, and the squeeze plates 4 and 4A, define two spaces into which molding sand is charged through the ports 8 and 8A. FIG. 1 shows the stage where sand has been charged. The squeeze plates 4 and 4A are at their original positions.

Figure 2:
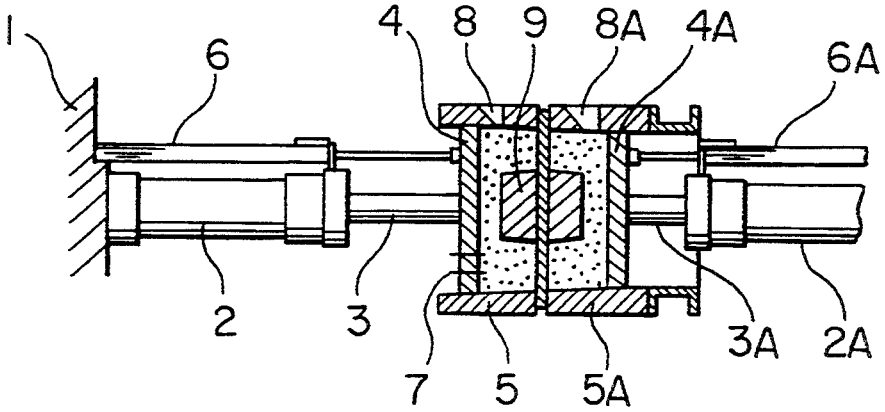
FIG. 2 is a partly diagrammatic sectional view of the device of FIG. 1, showing a state wherein the molding sand is compressed.

When the squeeze plates are at these original positions, the linear encoders 6 and 6A detect the original positions of the plates and send signals representative of the positions to the aforementioned programmable controller. Then the cylinders 2 and 2A push the squeeze plates 4 and 4A toward the match plate 9. Therefore, the charged sand is compressed as shown in FIG. 2, which shows the stage where the forming of the molds is completed.

The linear encoders 6 and 6A detect the final positions of the squeeze plates 4 and 4A and send signals representative of the final positions to the programmable controller, while the electrode 7 detects the electric resistance of the mold that is formed after compression and sends a corresponding signal to the controller.

The controller calculates the thicknesses of the molds based on the signals representative of the original and final positions of the squeeze plates 4 and 4A and calculates the water-content value of the mold based upon the signal from the electrode 7. These calculated thicknesses and value will be used as data to control the molding sand and the device.

Similarly to conventional molding, other processes, such as removing the match plate 9 from the molds, mating the cope and drag molds, casting, and removing a cast product and sand from the flasks, are carried out.

Thus, an improved molding device has been provided for detecting the electric resistance of the molding sand during its squeezing to form the cope and drag. One skilled in the art will appreciate that the present invention can be practiced by other than the described embodiment, which is presented for the purposes of illustration and not of limitation, and that the present invention is limited only by the claim that follows.

We claim:

1. A device for simultaneously forming a cope mold and a drag mold, comprising: a pair of flasks, a match plate held between the flasks, a pair of squeeze plates movably mounted on the flasks at opposite sides of the match plate so as to define two spaces for charging molding sand therein and so as to compact the sand to form the cope and drag molds, a pair of linear encoders connected to the squeeze plates for detecting the amounts of movements of the squeeze plates, and an electrode mounted on at least one of the squeeze plates, the electrode penetrating the squeeze plate to detect the electric resistance of the mold.

* * * * *